US006878171B1

(12) United States Patent
Ball

(10) Patent No.: US 6,878,171 B1
(45) Date of Patent: Apr. 12, 2005

(54) METHOD FOR FORMING A DISTINCT PATTERN IN AN ARTICLE OF APPAREL

(76) Inventor: Scott Ball, 11106 S. 2865 West, South Jordan, UT (US) 84095

( * ) Notice: Subject to any disclaimer, the term of this patent is extended or adjusted under 35 U.S.C. 154(b) by 33 days.

(21) Appl. No.: 10/369,975

(22) Filed: Feb. 19, 2003

(51) Int. Cl.[7] ..... D06P 5/12; D06P 5/02; D06L 3/00

(52) U.S. Cl. ..... 8/446; 8/101; 8/102; 8/552; 8/478; 8/448; 8/581; 8/632

(58) Field of Search ..... 8/445–448, 478, 8/581, 632, 101, 102, 552

(56) References Cited

U.S. PATENT DOCUMENTS 1,553,721 A * 9/1925 Scholz ..... 8/447
4,242,093 A 12/1980 Gasperini et al.
4,254,520 A * 3/1981 Saurman ..... 8/447
4,622,044 A * 11/1986 Nichols, Jr. ..... 8/485
4,820,310 A * 4/1989 Fukui ..... 8/456
5,019,131 A 5/1991 Nitsch, Jr.
5,118,322 A 6/1992 Wasinger et al.
5,131,914 A * 7/1992 Kelley ..... 8/449
5,131,915 A 7/1992 Mendoza
5,261,925 A 11/1993 Wasinger et al.
5,310,409 A 5/1994 Friday
5,313,811 A 5/1994 Wasinger et al.
5,342,415 A 8/1994 Wasinger et al.
5,366,510 A 11/1994 Wasinger et al.
5,376,143 A 12/1994 Wasinger et al.
5,531,796 A 7/1996 Wasinger et al.
5,554,195 A * 9/1996 Robert ..... 8/446
5,593,458 A 1/1997 Dickson et al.
5,613,983 A 3/1997 Terry et al.
5,951,714 A * 9/1999 Hall et al. ..... 8/102
5,984,977 A * 11/1999 Moore et al. ..... 8/478
6,139,590 A * 10/2000 Moore et al. ..... 8/448
6,168,635 B1 * 1/2001 Moore et al. ..... 8/478
6,201,044 B1 * 3/2001 Moore et al. ..... 524/56

* cited by examiner

*Primary Examiner*—Margaret Einsmann
(74) *Attorney, Agent, or Firm*—Thorpe North & Western LLP

(57) ABSTRACT

A method of forming a distinct pattern in an article of apparel formed of fabric, including the steps of: impregnating a viscous blocking agent into the fabric of the article of apparel in the distinct pattern; treating at least a portion of fabric surrounding the blocking agent in the distinct pattern to alter a color of the portion of fabric surrounding the blocking agent; and removing substantially all of the blocking agent from the article of apparel.

27 Claims, 2 Drawing Sheets

METHOD FOR FORMING A DISTINCT PATTERN IN AN ARTICLE OF APPAREL

BACKGROUND OF THE INVENTION

1. Field of the Invention

The present invention relates generally to forming a distinct pattern in an article of apparel.

2. Related Art

It is often desired to apply or create a distinct pattern or design in fabric of an article of apparel to improve an aesthetic appearance of the article. For instance, oftentimes popular tee shirts are altered by applying a pattern or design to the front or back of the fabric of the tee shirt to convey a message or display a logo or other information. Other articles of apparel, such as pants, coats, backpacks, etc. are also similarly adorned with distinct patterns or designs.

Due to complexities in apparel manufacturing, such distinct patterns or designs are often applied to the articles of apparel after the articles have been partly or wholly assembled. This is due to the fact that, while various dyeing, weaving, and other fabric manufacturing processes can be used to create a variety of colors or patterns in a fabric, it is difficult to apply a particular pattern or design to a fabric and have the pattern or design appear in a predetermined position on a finished article of apparel formed from the fabric. For example, if it is desired to create a pair of pants having a "stone washed" appearance, a quantity of denim can be treated to create "stone washed" fabric, and the various pieces of the pants, i.e., front, back, pockets, etc., are simply cut from the stone washed fabric and assembled or sewn together to form the pants. Because the entire piece of fabric includes the stone washed design, the cut-out pieces which are assembled to form the pants can be cut from any section of the stone washed denim.

However, difficulties arise if it is desired to apply a distinct pattern or design to a pair of pants only in a particular location on the pants, such as applying a particular picture or a particular phrase located and centered on one leg of the pants. If done prior to assembling the pants, the particular design or pattern would be applied to the fabric and the unassembled pieces of the pants would be cut precisely around the particular design to ensure that the design appeared in the proper area of the pants after assembling the pants. Exercising such care prior to cutting the pieces of the pants necessarily involves increased attention to tolerances, material management, and assembly of the pants, resulting in higher costs associated with manufacturing the pants.

Consequently, conventional methods of applying particular patterns or designs to articles of apparel have evolved such that, if a particular design is to be applied in a particular area of the article, it is generally applied after the article has been assembled. Some such methods known in the art include silk screening and embroidery. These conventional methods can be problematic in that they can be relatively expensive to apply. Also, the finished product produced by such methods necessarily includes added material, such as the silk screen or the embroidery thread, which protrudes above the upper surface of the fabric forming the article. Such added material can detract from the appearance of the original fabric used in the article of apparel. In addition, after repeated wear and washing, the added material forming the particular design can become damaged or removed from the fabric of the article of apparel, resulting in an article of apparel that is not aesthetically pleasing.

One method of altering an article of apparel after it has been assembled involves the process of dyeing or bleaching the fabric of the article of apparel to form differently colored sections of the fabric. For instance, a bleaching or dyeing process can be used to create popular "stone washed," "tie-dyed," "sand washed," or other types of apparel finishing after the apparel has been assembled. However, the methods used to create these types of articles have proven sufficiently imprecise such that they are utilized only in applications that do not require a high degree of definition. Dyeing or bleaching methods have proven successful when the desired result is a mottled, or otherwise undefined design, but have not been successfully used to create defined patterns or images in articles of apparel. For example, if a conventional dyeing or bleaching method is used to form a particular image, the image appears as a non-distinct or undefined image. To a person viewing the article of apparel, the pattern or design appears out of focus, or "blurry."

It is believed that the failure of conventional bleaching or dyeing methods to form patterns on articles of apparel is due in part to the wicking properties of fabric. If a dye or bleach is applied to a particular section of a fabric, the dye or bleach often wicks, or absorbs, into areas outside the particular section to which the bleach or dye was applied. Thus, if the bleach or dye is applied to the fabric in a particular design, the wicking effect causes the bleach or dye to wick beyond the edges of the particular design, and results in a finished design with a non-distinct or undefined appearance.

Some prior art methods have attempted to solve the problems associated with using bleaching or dyeing methods to apply distinct or defined designs to articles of apparel. One such method includes the use of masking material to mask a particular area on the surface of the fabric of the article. After the masking material is applied to the surface of the fabric, a bleaching or dyeing agent is used to color or discolor the fabric surrounding the masking material. Such masking materials include common masking tape, wax pencils, clay, grease, and other materials which are used to adhere to the surface of the fabric in an attempt to mask or block a dyeing or bleaching agent from affecting the area on which the masking material is applied.

These conventional prior art methods have proved problematic, however, because the masking material protects only the upper surface of the material. The problems associated with wicking or absorption of dyeing or bleaching agents are not addressed by these methods because the dyeing or bleaching agents wick, or absorb, into the fabric under the masking material. Attempts to use dyeing or bleaching agents in combination with masking materials to create defined, distinct designs in fabric have thus failed, as the resulting design is indistinct and undefined, and appears on the article of apparel as an out of focus, or "fuzzy" image.

SUMMARY OF THE INVENTION

It has been recognized that it would be advantageous to develop an article of apparel containing a defined, distinct pattern formed in the fabric of the article of apparel. It has been further recognized that it would be advantageous to develop a method of creating a distinct design in an article of apparel without requiring that decorative material be added to the surface of the article of apparel.

The invention provides a method of forming a distinct pattern in an article of apparel formed of fabric, and in one aspect includes the steps of: impregnating a viscous blocking agent into the fabric of the article of apparel in the distinct pattern; treating at least a portion of fabric surrounding the blocking agent in the distinct pattern to alter a color of the portion of fabric surrounding the blocking agent; and removing substantially all of the blocking agent from the article of apparel.

In accordance with another aspect of the invention, the step of treating at least a portion of fabric surrounding the blocking agent includes the step of bleaching at least a portion of fabric surrounding the blocking agent.

In accordance with another aspect of the invention, the step of bleaching at least a portion of fabric surrounding the blocking agent includes the step of submerging in a liquid bleaching agent at least a portion of the fabric surrounding the blocking agent for a treatment period of time.

In accordance with another aspect of the invention, the method includes the further step of varying the treatment period of time according to a desired level of bleaching of the fabric of the apparel surrounding the blocking agent in the distinct pattern.

In accordance with another aspect of the invention, the step of impregnating the viscous blocking agent into the fabric of the article of apparel comprises the further step of forcing the viscous blocking agent into and substantially below an upper surface of the fabric of the article of apparel.

In accordance with another aspect of the invention, the method includes the further step of scouring substantially all of any exposed blocking agent from an upper surface of the fabric of the article of apparel before treating at least a portion of the fabric of the article of apparel.

In accordance with another aspect of the invention, the viscous blocking agent includes an elastomeric compound including at least a solvent component and a base elastomer component.

In accordance with another aspect of the invention, the elastomeric compound includes a silicone compound.

In accordance with another aspect of the invention, the solvent component of the elastomeric compound includes a chlorinated solvent.

In accordance with another aspect of the invention, the method includes the further step of at least partially curing, for a cure time, the elastomeric compound within the fabric of the article of apparel in the distinct pattern before treating at least a portion of fabric surrounding the elastomeric compound in the distinct pattern.

In accordance with another aspect of the invention, the method includes the further step of treating at least a portion of the fabric surrounding the blocking agent in the distinct pattern before the elastomeric compound has substantially fully cured.

In accordance with another aspect of the invention, the method includes the further step of selecting a viscosity of the viscous blocking agent based on a porosity of the fabric of the article of apparel.

In accordance with yet another aspect of the invention, a method of forming a distinct pattern in an article of apparel formed of fabric is provided, and includes the steps of: preserving a color of a design section of the fabric of the article apparel in the distinct pattern with an impregnated preserving compound; treating a color of at least a portion of fabric adjacent the design section of the fabric of the article of apparel to alter the color of the portion of fabric adjacent the design section; and removing substantially all of the preserving compound from the article of apparel.

In accordance with another aspect of the invention, the step of preserving the color of the design section of the fabric includes the step of forcing the preserving compound into and substantially below an upper surface of the fabric of the article of apparel.

In accordance with another aspect of the invention, the step of treating the color of at least a portion of fabric adjacent the design section includes the step of bleaching at least a portion of fabric surrounding the design section.

In accordance with another aspect of the invention, the step of bleaching at least a portion of fabric adjacent the design section includes the step of submerging, for a treatment period of time, at least a portion of fabric adjacent the design section in a liquid bleaching agent.

In accordance with another aspect of the invention, the method includes the further step of varying the treatment period of time according to a desired level of bleaching of the fabric of the apparel surrounding the design section.

In accordance with another aspect of the invention, the method includes the further step of scouring substantially all of any exposed preserving compound from an upper surface of the fabric of the article of apparel before treating the color of at least a portion of the fabric of the article of apparel.

In accordance with another aspect of the invention, the preserving compound includes an elastomeric compound including at least a solvent component and a base elastomer component.

In accordance with another aspect of the invention, the elastomeric compound includes a silicone compound.

In accordance with another aspect of the invention, the solvent component of the elastomeric compound includes a chlorinated solvent.

In accordance with another aspect of the invention, the method includes the further step of at least partially curing, for a cure time, the elastomeric compound within the fabric of the article of apparel in the design section before treating the color of at least a portion of fabric adjacent the design section of the fabric of the article of apparel.

In accordance with another aspect of the invention, the method includes the further step of treating the color of at least a portion of the fabric adjacent the design section before the elastomeric compound has substantially fully cured.

In accordance with another aspect of the invention, the method includes the further step of selecting a viscosity of the preserving compound based on a porosity of the fabric of the article of apparel.

Additional features and advantages of the invention will be apparent from the detailed description which follows, taken in conjunction with the accompanying drawings, which together illustrate, by way of example, features of the invention.

DETAILED DESCRIPTION

Figure 1:
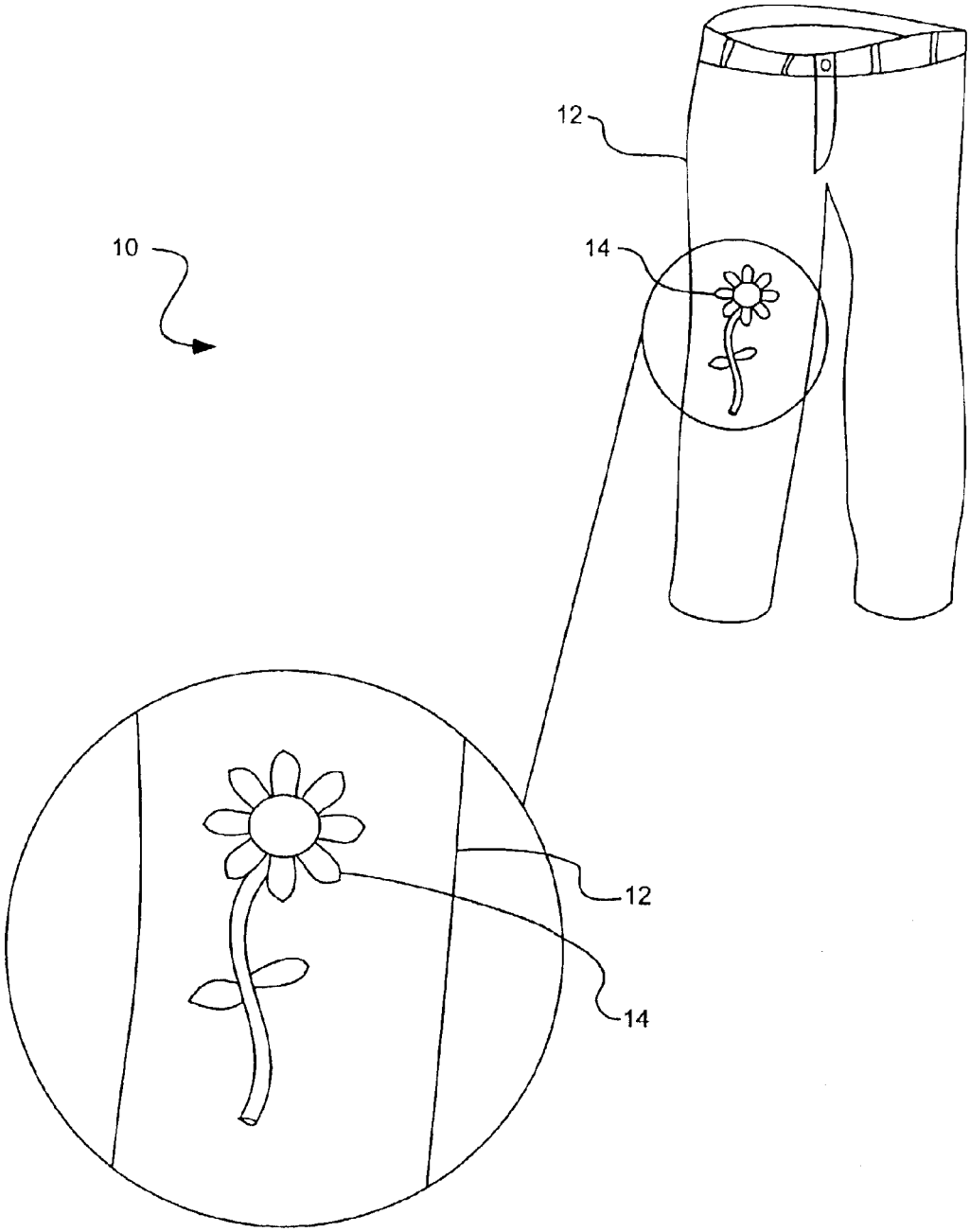
FIG. 1 is a perspective view of a distinct pattern formed in an article of apparel in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated at 10 in FIG. 1, an article of apparel 12 in accordance with the present invention is provided. In one aspect of the present invention, the article of apparel 12 includes a distinct pattern 14 formed in the article of apparel. As discussed in more detail below, the distinct pattern is formed within the fabric of the article of apparel and, in one embodiment, is evident in the article of apparel due to the distinct pattern's relatively darker color than that of the fabric surrounding the distinct pattern. The distinct pattern 14, while shown generally as a decorative flower in FIG. 1, can include any number of designs, words, or patterns. For instance, the distinct pattern can be the logo of a particular company, or a particular word, phrase, or name.

Similarly, while the article of apparel 12 is shown in FIG. 1 as a pair of pants, it is to be understood that the present invention can be utilized in all manner of articles of apparel, including shirts, tee shirts, pants, hats, backpacks, coats, and other articles of apparel as would occur to one skilled in the art. The article of apparel is generally formed of fabric, which can be of any type known to those skilled in the art, including, but not limited to, denim, cotton, polyester or other fabric.

A method, in accordance with one embodiment of the present invention, for forming a distinct pattern in an article of apparel formed of fabric includes the step of impregnating the fabric of the article of apparel with a viscous blocking agent applied to the fabric in the distinct pattern. The fabric surrounding the blocking agent impregnated in the fabric of the article of apparel can then be treated with a treating agent to alter a color of the fabric surrounding the blocking agent. Substantially all of the impregnated blocking agent can then be removed from the article of apparel, leaving only the fabric of the article of apparel containing the distinct pattern formed within the fabric. As the color of the fabric which surrounds the distinct pattern has been altered, the distinct pattern appears as a darker shade or color of fabric than the fabric defined by the distinct pattern in which the blocking agent was previously disposed.

Because the viscous blocking agent is impregnated into the fabric of the article of apparel, the present invention advantageously allows bleaching or treating agents to be used in combination with blocking agents to form distinct patterns in an article of apparel. By impregnating or penetrating the fabric with the blocking agent prior to bleaching or treating the fabric, the bleaching or treating agent applied to the fabric affects only the areas of fabric surrounding the distinctive pattern, and not the fabric of the distinct pattern defined by the blocking agent. The bleaching or treating agent is effectively blocked from bleaching or treating the fabric containing the blocking agent, resulting in a crisp, well defined, and distinct pattern formed in the fabric.

As will be appreciated by those skilled in the art, various fabrics contain varying degrees of coloring agents, including natural colors and additives such as dyes. The present invention encompasses treating or bleaching fabrics colored in all manners by removing or altering the coloring agents contained in the fabric. While the discussion herein is meant to address all aspects of the present invention, reference to a treating agent, bleaching agent, oxidizing agent, or other agent or material will be made with the term "treating agent," while the term "treating agent" will be understood to encompass any such material that can be used to alter the color of or add color to a fabric. The treating agent can also be-a dyeing agent, which applies additional or different coloring to the fabric. While in one aspect of the invention the treating agent includes a liquid bleach, the treating agent can also be a gaseous or solid solution. In addition, the treating agent can also be a radiation source, such as sunlight or another light or radiation source that fades or otherwise alters the color of the fabric.

In one aspect of the invention, the blocking agent or preserving compound is removed or washed from the fabric once a desired level of bleaching or treating has been accomplished. Once the process is complete, the distinct pattern or design in the fabric is defined by differences in color or shading of the fabric, without the addition of material that may protrude above the surface of the fabric. Thus, the pattern or design appears more "natural" than prior art methods in that the image appears as a darker section of the original fabric surrounded by a more faded section of the fabric. As discussed in more detail below, the process can be adjusted for varying levels of treatment, such that the image or pattern can be made to appear slightly darker than the surrounding fabric, or in sharp contrast to the surrounding fabric, depending on the results desired.

The blocking agent or preserving compound can be any substance that resists the effects of the treating agent, such as fading or oxidization of the color of the fabric. Various aspects of the invention can utilize preserving agents which include, but are not limited to, elastomeric compounds or materials. Elastomeric materials generally have the physical quality or property of recovering their original volume or shape after being altered by an external force. The elastomeric compound or material can include a mixture of base elastomers and other ingredients, such as curing agents, reinforcers, and processing aids, which can be selected to obtain the physical and chemical properties desired of the blocking or preserving compound.

The use of elastomeric compounds can be advantageous in that, once applied in a distinct pattern to fabric of an article of apparel, the elastomeric compound can "bend" with the fabric and return to the configuration in which it was originally applied to the fabric. That is, the elastomer moves with the fibers of the fabric, similar to an elastic member, to expand and contract with the fabric to preserve the fabric of the distinct pattern in which the elastomeric compound was applied.

Examples of elastomeric materials used in various aspects of the present invention include, but are not limited to, polyisoprene, polychloroprene, butyl elastomers, nitrile elastomers, chlorosulphonated polyethylene, polyurethancs, cork composites, and silicones. In one aspect of the invention, the elastomeric compound can be a silicone compound, such as VMQ silicone. In addition to these elastomeric blocking agents, non-elastomeric polymers can also be used as the blocking agent or preserving compound.

In one aspect of the invention, the elastomeric compound can include both a solvent component and a base elastomer component. The base elastomer component can serve as the component that physically and chemically blocks the treating agent from affecting the fabric of the distinct pattern, thereby preserving the distinct pattern in its original color condition. The solvent component can carry, or serve as a vehicle for, the base elastomer component. The solvent component of the blocking agent or preserving compound carries the base elastomer component, and, once applied to the fabric, the blocking agent begins to "cure." As the solvent vaporizes, the base elastomer is left behind in a much more concentrated state. Various aspects of the present invention utilize the curing characteristics of the blocking agent or preserving compound, as discussed in more detail below.

Examples of a curing component that can be included in the compound include, but are not limited to, low or high temperature peroxides, which include shorter and longer cure cycles, respectively. In one aspect of the invention, the solvent component includes a chlorinated solvent, such as trichloroethylene, perchloroethylene, or methylene chloride.

In one aspect of the invention, the solvent component of the elastomeric compound serves several purposes and can be selected according to various considerations. In addition, the solvent component serves as a vehicle for carrying the base elastomer component into and substantially below an upper surface of the fabric of the article of apparel. Thus, as the blocking agent or preserving compound is applied to the fabric, the solvent assists in drawing the base elastomer component of the blocking agent into the fabric.

Advantageously, the solvent component of the preserving compound can "compete" with the base elastomer component while the preserving compound is absorbed into the fabric. In one aspect, the solvent absorbs into fibers of the fabric first, after which the solvent partially prohibits absorption of the base elastomer component into the fibers. Thus, the molecules of the base elastomer component reside primarily on the outer surfaces of the fibers of the fabric. The base elastomer component thus effectively preserves the fibers from the affect of the treating agent, but is more easily removed from the fabric after the process is complete. In addition, the solvent component can also act as a "finish" on the fibers of the fabric, helping in removing the blocking agent or preserving compound from the fabric after the process is complete.

In combination with these considerations, the solvent component also affects the overall viscosity of the blocking agent or preserving compound. The viscosity of the blocking agent affects the degree to which the blocking agent is absorbable into the fabric. A relatively high viscosity preserving agent can be more difficult to impregnate into the fabric. Contrarily, a relatively low viscosity preserving compound will be readily absorbable into the fabric, but may lead to an undefined or blurry pattern being formed in the fabric, as the blocking agent may wick or be absorbed into areas of the fabric other than the distinct pattern in which the blocking agent was applied.

The base elastomer component can also be selected from a variety of materials according to desired results of the process. In addition, pigments can be added to the base elastomer component to act as a coloring agent within the distinct pattern. The solvent and base elastomer components can each be a combination of one or more materials, and can be altered in volumetric ratio according to a desired affect. In one aspect, a silicone base is used with a chlorinated solvent in about a 2:1 ratio by volume. Because mixing of elastomeric compounds is a dispersive action, in one aspect of the invention the solvent and base elastomer components are mixed in a low speed mixing process.

Figure 2A:
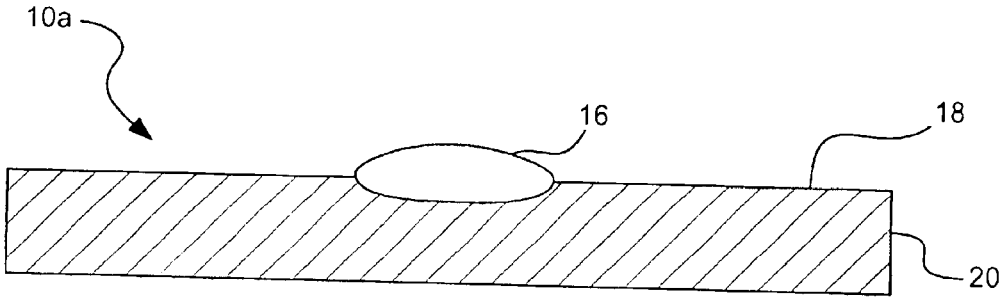
FIG. 2*a* is a side, cross-sectional view of one stage of a pattern being formed in the article of apparel of FIG. 1.
Figure 2B:
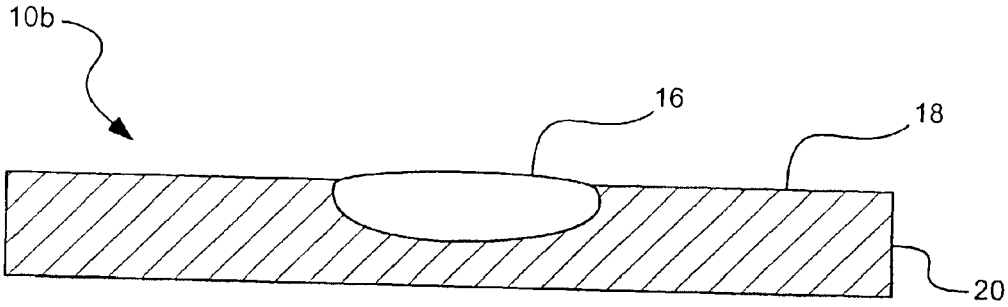
FIG. 2*b* is a side, cross-sectional view of another stage of the pattern being formed in the article of apparel of FIG. 1.
Figure 2C:
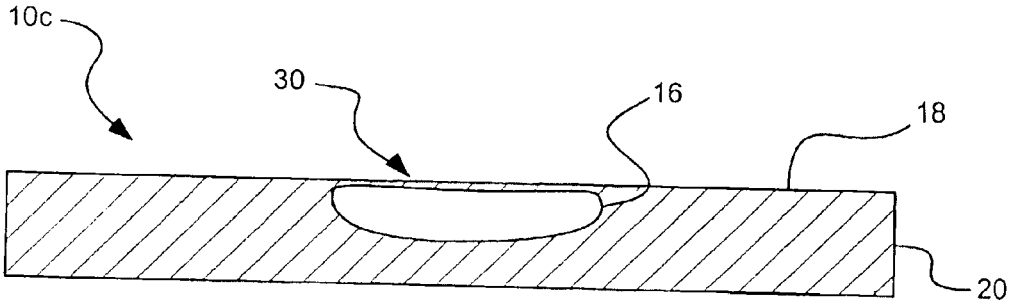
FIG. 2*c* is a side, cross-sectional view of another stage of the pattern being formed in the article of apparel of FIG. 1.

FIGS. 2*a* through 2*c* illustrate one sequence of the application of one embodiment of the present invention. Shown in a first stage in cross section at 10*a* in FIG. 2*a*, blocking agent 16 can be applied to an upper surface 18 of fabric 20. Due to the solvent component of the blocking agent 16, the blocking agent begins to at least partially penetrate the fabric 20 relatively quickly, as the solvent begins carrying the blocking agent into the fabric. While the solvent component of the blocking agent carries the base elastomer component into the fabric, the relative viscosity of the blocking agent aids in retaining the blocking agent in the distinct pattern in which it was applied to the fabric 20.

As shown in FIG. 2*a*, in one aspect the blocking agent 16 is first applied to the upper surface of the fabric 20, after which it begins to at least partially absorb into and below the upper surface 18 of the fabric. The blocking agent can be applied to the fabric in a number of ways. For example, the blocking agent can be "painted" or brushed onto the fabric. Stenciling can also be used to more accurately apply the blocking agent in the distinct pattern. In addition, the blocking agent can be air brushed or otherwise impelled onto or into the fabric. In one aspect of the invention, the blocking agent can be applied with an air brush operating at a pressure of about 50 psi.

In one aspect of the invention, the step of impregnating the blocking agent or preserving compound into the fabric includes the step of forcing the blocking agent or compound into and substantially below the upper surface 18 of the fabric 20. FIG. 2*b* illustrates a later stage of the process, after the blocking agent 16 has been forced substantially below the upper surface 18 of fabric 20. Because of the relatively high viscosity of the preserving agent, the preserving agent retains the distinct pattern (not evident in FIGS. 2*a* through 2*c*) in which it was applied even after being forced into the fabric. In those aspects where the blocking is only partially embedded or impelled into the fabric as a result of application of the blocking agent to the fabric, a roller or calender can be used to force the blocking agent deeper into the fabric to achieve optimal penetration.

FIG. 2*c* shows an alternate stage of the process, in which substantially all of any exposed blocking agent has been scoured from the upper surface 18 of the fabric 20. As shown in FIG. 2*c*, this step in the process can result in a thin layer 30 of untreated or un-blocked fabric immediately above the distinct pattern. Scouring any exposed blocking agent from the fabric can achieve a finished product that includes distinct pattern having an appearance of depth, relative to the upper surface.

Once the blocking agent has been applied and forced into a desired shape and depth, the blocking agent can be allowed to cure until a desired level of curing has been reached. Because a proportionally high solvent content in the blocking agent may result in the blocking agent being "washed" away from the distinct pattern when treated with a treating agent, the blocking agent can be allowed to cure prior to treatment to more effectively "set" the base elastomer component within the fabric. In addition, in one aspect of the invention, the fabric surrounding the distinct pattern is treated before the blocking agent or preserving compound has been fully cured. In this aspect, some of the solvent remains in the blocking agent to aid in removing the blocking agent after completion of the process.

The cure time of the blocking agent or preserving compound can also be varied according to the treatment process desired. For instance, if the surrounding fabric is to be considerably lightened compared to the color of the preserved fabric in the distinct pattern, it may be necessary to treat the fabric for an extended period of time, or with a particularly aggressive treating agent. In such a case it may be desired to cure the blocking agent for a longer period of time to more fully, or deeply, cure the blocking agent. This will remove a greater amount of the solvent, leaving a higher concentration of base elastomer component to better preserve the fabric in the distinct pattern from being affected by the treating agent.

When the blocking agent has achieved optimal curing for the process desired, the fabric surrounding the blocking agent can be treated with a treating agent to alter a color of the fabric surrounding the blocking agent. As the blocking agent was applied in the distinct pattern, the process preserves a distinct pattern in the fabric that appears as a different color than the treated area surrounding the distinct pattern. As used herein, the term "color" is meant to embrace a wide range of meanings as understood by those skilled in the art. "Color" is meant not only to indicate hue or tint of color, but also intensity, brightness, etc., of color that effects the manner in which the color is perceived by the human eye. Thus, treated and untreated sections of the fabric can differ in color by exhibiting, for example, different levels of "fading," brightness, hue or tint.

In one embodiment of the present invention, the step of treating at least a portion of fabric surrounding the blocking agent includes the step of bleaching at least a portion of fabric surrounding the blocking agent. The bleaching step can be done using a variety of methods, and in one embodiment includes submerging at least a portion of the fabric surrounding the blocking agent in a liquid bleaching agent. To enable a greater range of treatments available with the present invention, the step of submerging at least a portion of the fabric surrounding the blocking agent in a liquid bleaching agent can be done for a varying treatment period of time. By varying the treatment time in which the fabric is subject to contact with the bleaching agent, the resulting intensity of the bleaching process can be altered, leading to a distinct pattern that is more or less in contrast with the surrounding fabric.

In one embodiment, the treatment period of time can be determined by a desired level of bleaching of the fabric of the article of apparel surrounding the blocking agent. Thus, for a starkly contrasting appearance, a long bleaching period can be selected, and the fabric surrounding the distinct pattern will appear greatly different in color as compared to the fabric treated with the blocking agent. In contrast, a shorter bleaching or treating period can be selected to obtain a more subtle contrast between the bleached or treated areas and the distinct pattern area which was preserved by the impregnated blocking agent.

Once the desired level of bleaching or treatment is reached, the impregnated blocking agent and treating agent can be removed from the fabric. The removal process can be accomplished in a number of ways, and in one embodiment includes washing the article of apparel until the blocking agent is removed. Of course, any removal techniques known to those skilled in the art can also be utilized.

In addition to the examples provided above, one embodiment of the present invention includes the step of selecting a viscosity of the blocking agent based on a porosity of the fabric of the article of apparel. Thus, depending on the type of fabric in the article of apparel, the viscosity of the viscous blocking agent may be selected to optimize the impregnation of the fabric in a distinct, defined pattern. That is, by varying the solvent component and base elastomer component of the blocking agent or preserving compound, the blocking agent can be "tailored" to the fabric to produce the most effective results.

As used herein, the term "substantially below the upper surface" is understood to define a condition in which the section or element being discussed extends below the upper surface of the section or element being discussed by at least about 20% of a total thickness of the section or element being discussed. In accordance with one aspect of the invention, "substantially below the upper surface" defines a condition in which the section or element being discussed extends below the upper surface of the section or element being discussed by at least about 20% to 65% of a total thickness of the section or element being discussed.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A method of forming a distinct pattern in an article of apparel formed of fabric, comprising the steps of:

a) impregnating a blocking agent into the fabric of the article of apparel in the distinct pattern, the blocking agent including an elastomeric composition including at least a solvent component and a base elastomer component;

b) treating at least a portion of fabric surrounding the blocking agent in the distinct pattern to alter a color of the portion of fabric surrounding the blocking agent; and c) removing substantially all of the blocking agent from the article of apparel.

2. A method in accordance with claim 1, wherein the step of treating at least a portion of fabric surrounding the blocking agent includes the step of bleaching at least a portion of fabric surrounding the blocking agent.

3. A method in accordance with claim 2, wherein the step of bleaching at least a portion of fabric surrounding the blocking agent includes the step of submerging in a liquid bleaching agent at least a portion of the fabric surrounding the blocking agent.

4. A method in accordance with claim 3, comprising the further step of varying a period of time in which the portion of the fabric surrounding the blocking agent is submerged in the liquid bleaching agent according to a desired level of bleaching of the fabric of the apparel surrounding the blocking agent in the distinct pattern.

5. A method in accordance with claim 1, wherein the step of impregnating the blocking agent into the fabric of the article of apparel comprises the further step of forcing the blocking agent into and substantially below an upper surface of the fabric of the article of apparel.

6. A method in accordance with claim 1, comprising the further step of scouring substantially all of any exposed blocking agent from an upper surface of the fabric of the article of apparel before treating at least a portion of the fabric of the article of apparel.

7. A method in accordance with claim 1, wherein the elastomeric composition includes a silicone composition.

8. A method in accordance with claim 1, wherein the solvent component of the elastomeric composition includes a chlorinated solvent.

9. A method in accordance with claim 8, comprising the further step of at least partially curing the elastomeric composition within the fabric of the article of apparel in the distinct pattern before treating at least a portion of fabric surrounding the elastomeric composition in the distinct pattern.

10. A method in accordance in with claim 9, comprising the further step of treating at least a portion of the fabric surrounding the blocking agent in the distinct pattern before the elastomeric composition has substantially fully cured.

11. A method in accordance with claim 1, comprising the further step of selecting a viscosity of the blocking agent based on a porosity of the fabric of the article of apparel.

12. A method of forming a distinct pattern in an article of apparel, comprising the steps of:

a) obtaining a finished article of apparel comprised of fabric which has been treated with a coloring agent;

b) applying an elastomer-based blocking agent to the fabric of the apparel in the distinct pattern;

c) forcing the blocking agent into and substantially below an upper surface of the fabric of the article of apparel in the distinct pattern;

d) submerging at least a portion of fabric of the article of apparel surrounding the blocking agent into a liquid bleaching agent to bleach at least a portion of the fabric surrounding the impregnated blocking agent to discolor at least a portion of fabric surrounding the blocking agent; and e) washing the article of apparel to remove substantially all of the blocking agent and the liquid bleaching agent from the fabric of the article of apparel.

13. A method in accordance with claim 12, wherein the at least a portion of fabric is submerged in the liquid bleaching agent for a period of time determined by a desired level of bleaching of the fabric of the article of apparel surrounding the blocking agent.

14. A method in accordance with claim 12, comprising the further step of selecting a viscosity of the blocking agent based on a porosity of the fabric of the article of apparel.

15. A method in accordance with claim 12, wherein the elastomer-based blocking agent includes a chlorinated solvent component.

16. A method in accordance with claim 12, comprising the further step of scouring substantially all of any exposed blocking agent from an upper surface of the fabric of the article of apparel before submerging at least a portion of fabric of the article of apparel surrounding the blocking agent into the liquid bleaching agent.

17. A method of forming a distinct pattern in an article of apparel formed of fabric, comprising the steps of:

a) preserving a color of a design section of the fabric of the article of apparel in the distinct pattern with a blocking agent impregnated in the fabric of the article of apparel;

b) scouring substantially all of any exposed blocking agent from an upper surface of the fabric of the article of apparel;

c) treating a color of at least a portion of fabric adjacent the design section of the fabric of the article of apparel to alter the color of the portion of fabric adjacent the design section; and d) removing substantially all of the blocking agent from the article of apparel.

18. A method in accordance with claim 17, wherein the step of preserving the color of the design section of the fabric includes the step of forcing the blocking agent into and substantially below an upper surface of the fabric of the article of apparel.

19. A method in accordance with claim 17, wherein the step of treating a color of at least a portion of fabric adjacent the design section includes the step of bleaching at least a portion of fabric surrounding the design section.

20. A method in accordance with claim 19, wherein the step of bleaching at least a portion of fabric adjacent the design section includes the step of submerging at least a portion of fabric adjacent the design section in a liquid bleaching agent.

21. A method in accordance with claim 20, comprising the further step of varying a period of time in which at least a portion of fabric adjacent the design section is submerged in the liquid bleaching agent according to a desired level of bleaching of the fabric of the apparel surrounding the design section.

22. A method in accordance with claim 17, wherein the blocking agent includes an elastomeric composition including at least a solvent component and a base elastomer component.

23. A method in accordance with claim 22, wherein the elastomeric composition includes a silicone compound.

24. A method in accordance with claim 22, wherein the solvent component of the elastomeric composition includes a chlorinated solvent.

25. A method in accordance with claim 22, comprising the further step of at least partially curing the elastomeric composition within the fabric of the article of apparel in the design section before treating the color of at least a portion of fabric adjacent the design section of the fabric of the article of apparel.

26. A method in accordance in with claim 25, comprising the further step of treating the color of at least a portion of the fabric adjacent the design section before the elastomeric composition has substantially fully cured.

27. A method in accordance with claim 17, comprising the further step of a viscosity of the blocking agent based on a porosity of the fabric of the apparel.

* * * * *